US006863542B2

(12) United States Patent
Miyashita

(10) Patent No.: US 6,863,542 B2
(45) Date of Patent: Mar. 8, 2005

(54) INTERCONNECTING STRUCTURE FOR ELECTRICALLY CONNECTING TWO PRINTED CIRCUIT BOARDS

(75) Inventor: Ikuhito Miyashita, Fukui (JP)

(73) Assignee: Orion Electric Co., Ltd., Fukui (JP)

( * ) Notice: Subject to any disclaimer, the term of this patent is extended or adjusted under 35 U.S.C. 154(b) by 72 days.

(21) Appl. No.: 10/367,809

(22) Filed: Feb. 19, 2003

(65) Prior Publication Data

US 2003/0224631 A1 Dec. 4, 2003

(30) Foreign Application Priority Data

Feb. 18, 2002 (JP) ..... 2002-040121

(51) Int. Cl.[7] ..... H01R 12/00
(52) U.S. Cl. ..... 439/74
(58) Field of Search ..... 439/74, 65, 67, 439/492, 493, 495, 499, 591, 75, 246–249, 329

(56) References Cited

U.S. PATENT DOCUMENTS 5,800,186 A * 9/1998 Ramirez et al. ..... 439/74
5,967,785 A * 10/1999 Maeda et al. ..... 439/493
6,053,747 A * 4/2000 Aggus et al. ..... 439/67
6,341,966 B1 * 1/2002 Takada et al. ..... 439/74
6,435,897 B1 * 8/2002 Paul et al. ..... 439/374
6,477,059 B1 * 11/2002 Ono et al. ..... 439/493

FOREIGN PATENT DOCUMENTS

JP 11-297387 10/1999

* cited by examiner

*Primary Examiner*—P. Austin Bradley
*Assistant Examiner*—Felix O. Figueroa
(74) *Attorney, Agent, or Firm*—Wenderoth, Lind & Ponack, L.L.P.

(57) ABSTRACT

Disclosed is a printed circuit board-interconnecting structure for integrating two printed circuit boards in a state of being electrically connected. The manufacturing cost is minimized. The board integrating structure permits the automatization of assembling parts, and can meet the occasional requirements for changing the inter-distance between the confronting printed circuit boards. Each printed circuit board has an ordinary connector attached to one side, and a rectangular hollow socket is sandwiched between the confronting printed circuit boards to enclose the connectors, and a short length of flexible flat cable lined with a reinforcement piece traverses the inter-space between the confronting connectors forts conductors to be put in contact with the terminals of the connectors.

3 Claims, 7 Drawing Sheets

INTERCONNECTING STRUCTURE FOR ELECTRICALLY CONNECTING TWO PRINTED CIRCUIT BOARDS

BACKGROUND OF THE INVENTION

1. Field of the Invention

The present invention relates to an interconnecting structure for electrically connecting two printed circuit boards leaving a predetermined space therebetween.

2. Related Art

Printed circuit boards each having a plurality of electronic parts attached thereto are used in an electric or electronic apparatus. A single large printed circuit board is divided into a plurality of divisions, which are arranged horizontally at intervals or vertically at different levels to form a horizontal arrangement or vertical stack of divisional printed circuit boards, which are all electrically connected with the aid of connectors.

A variety of connectors are used for connecting divisional printed circuit boards. One example of such connectors is shown in Japanese Patent 11-297387(A), titled "Interconnecting Structure for Electrically Connecting Two Printed Circuit Boards". It is an improvement of an interconnecting structure for electrically connecting together a first printed circuit board having a female connector part fixed thereto and a second printed circuit board having a male connector part fixed thereto. The female connector part is fixed on the upper side of the first printed circuit board with its receptacle apertures open on the lower side. The male connector part is fixed on the upper side of the second printed circuit board with its terminal pins standing upright. The first printed circuit board is laid above the second printed circuit board with the receptacle apertures of the female connector part aligned with the terminal pins of the male connector part, thus permitting insertion of the terminal pins into the receptacle apertures from the lower side of the first printed circuit board. The feature of the printed circuit board-interconnecting structure resides in that: the male connector part has a cross stopper to determine the space between the first and second printed circuit boards. Specifically, the cross stopper has threaded guide pins standing upright on its opposite ends, and the first printed circuit board has guide holes made therein. The first and second printed circuit boards are combined together by inserting the threaded guide pins in the guide holes, and by fastening them to the first printed circuit board with butterfly nuts.

The male connector part has numerous terminal pins and two threaded guide pins standing upright, passing through the cross stopper. Such a complicated connector part is difficult to produce, and accordingly the manufacturing cost is relatively high. Still disadvantageously the first printed circuit board needs to be laid on the cross stopper with the terminal pins and threaded guide pins of the male connector part inserted in the receptacle apertures and guide holes of the first printed circuit board, and then, the first printed circuit board needs to be fastened to the second printed circuit board by screwing the butterfly nuts onto the threaded guide pins. Thus, assembling work is not easy. Insertion of numerous terminal pins in the through holes made in the cross stopper prevents automatization of the assembling work.

FIG. 7 shows another conventional interconnecting structure, in which first and second printed circuit boards 1 and 2 have female and male connector parts 21 and 22 fixed thereto respectively. The female connector part 21 is ordinary in structure, and less expensive. The male connector part 22, however, is not ordinary, and complicated in structure, and therefore it is much more expensive than the ordinary female connector part.

As is the case the interconnecting structure disclosed in Japan Patent 11-297387(A), the male connector part 22 has numerous terminal pins standing upright to be inserted in the apertures of the female connector part 21, thus preventing automatization of the assembling work. Still disadvantageously, the height of the male connector part varies with the distance between the first and second printed circuit boards 1 and 2. Male connector parts of different heights, therefore, need to be prepared to meet the inter-distance as required.

In view of the above, one object of the present invention is to provide an interconnecting structure which is free of such defects as described above, permitting automatization of the assembling work, enabling two printed circuit boards to be connected together regardless of the board-to-board distance, and reducing the manufacturing cost to the minimum possible.

SUMMARY OF THE INVENTION

To attain this object an interconnecting structure for electrically connecting two printed circuit boards, leaving a predetermined space therebetween, is improved according to the present invention in that it comprises: two connectors each attached to one or the other printed circuit board by inserting its terminal pins into the holes of the printed circuit board; a socket to be fixed to the printed circuit boards, the connectors being adapted to be press-fitted in the hollow space of the socket; and a length of cable such as a flat flexible cable, having its conductors put in contact with the terminal pins of the connectors, the cable being lined with a reinforcement piece.

Both connectors are ordinary in structure, and the soldering tails of each connector can be inserted in counter holes of either printed circuit board to be soldered to selected portions of the printed circuit. The connectors can be mated together, when they are press-fitted in the hollow space of the socket via the intervening flat flexible cable. The flat flexible cable is sandwiched between the first and second printed circuit boards to be connected to the confronting connectors. The flat flexible cable has its flat strip conductors covered with a film insulator, and it is lined with a reinforcement piece to increase its resistance to bending force, thereby assuring that reliable electric connection is made between the confronting connectors. A glass-epoxy printed circuit board may be used in place of the flat flexible circuit.

The socket may comprise a rectangular hollow frame having posts extending in opposite directions, and two legs extending from the opposite sides of the rectangular hollow frame in one direction, each leg having a nail formed on its free end to be caught by an associated hole made on one of the printed circuit boards.

With this arrangement the socket can be fixed to the first and second printed circuit boards by inserting the posts extending in the opposite directions into the counter holes made in the first and second printed circuit boards, and by inserting the legs into the counter holes made in the second printed circuit board until their nails are caught by the hole edges.

Other objects and advantages of the present invention will be understood from the following description of a printed circuit board-interconnecting structure according to one preferred embodiment of the present invention, which is shown in the accompanying drawings.

DETAILED DESCRIPTION OF PREFERRED EMBODIMENT

Figure 1B:
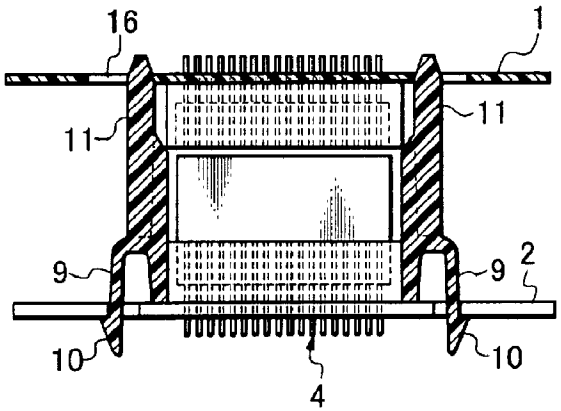
FIGS. 1(*a*), (*b*), (*c*) and (*d*) illustrate the structure of a printed circuit board-interconnecting structure according to the present invention at subsequent steps in coupling first and second printed circuit boards together.
Figure 1D:
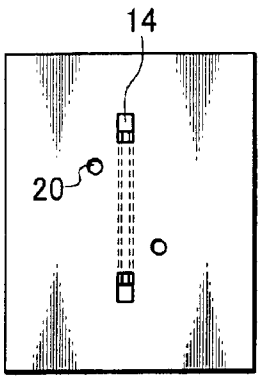
Figure 1A:
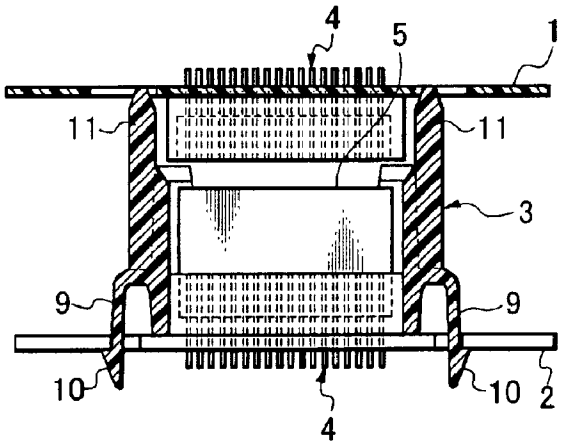
Figure 1C:
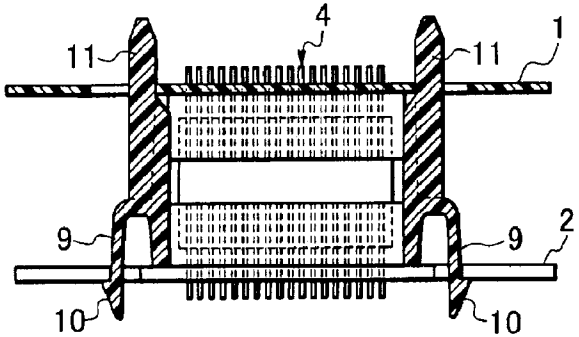
Figure 2A:
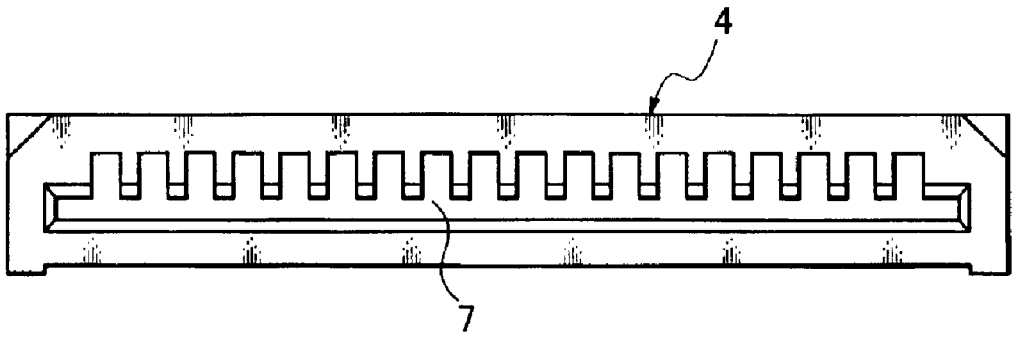
FIGS. 2(*a*) and (*b*) are top and front elevational view of a connector used in the printed circuit board-interconnecting structure.
Figure 2B:
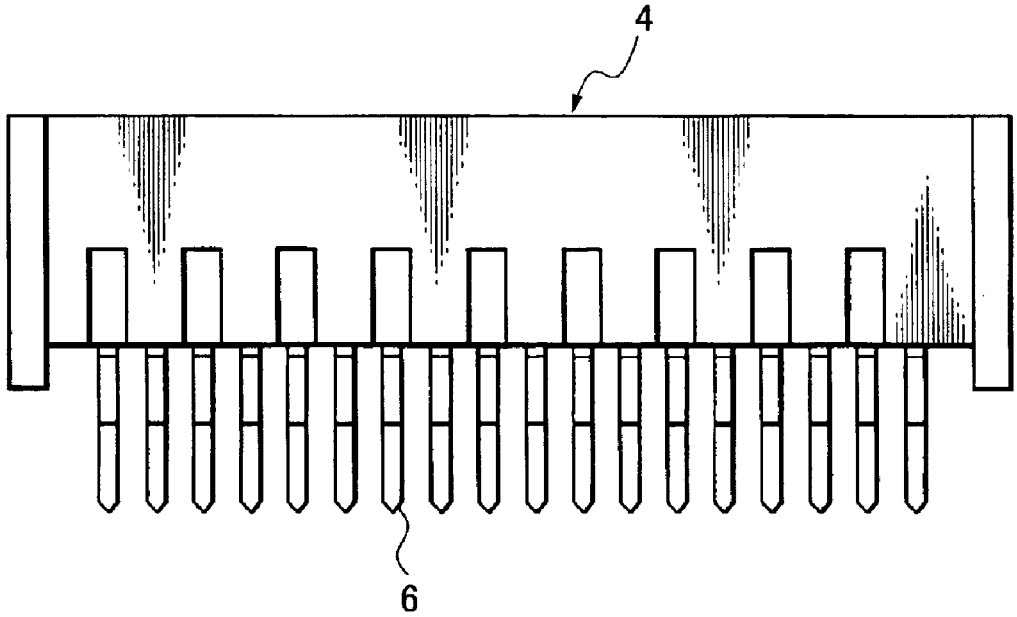

FIGS. 1(*a*)–1(*d*) illustrate how upper and lower printed circuit boards 1 and 2 can be joined and electrically connected together. In the drawing a socket is indicated by the reference numeral 3; connectors by the reference numeral 4; and a flexible, flat cable (FFC) by the reference numeral 5. Referring to FIGS. 2(*a*) and 2(*b*), the connector 4 has a plurality of terminal pins 6 extending on one side, and a corresponding plurality of insertion holes 7 formed on the other side. The terminal pins 6 of the connector 4 are inserted in the terminal holes formed in the upper or lower printed circuit board 1 or 2 to be soldered to selected conductors of the printed circuit.

Figure 3C:
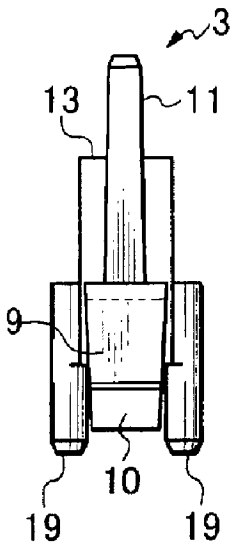
FIGS. 3(*a*), (*b*) and (*c*) are top, sectional and side views of a socket used in the printed circuit board-interconnecting structure.
Figure 3B:
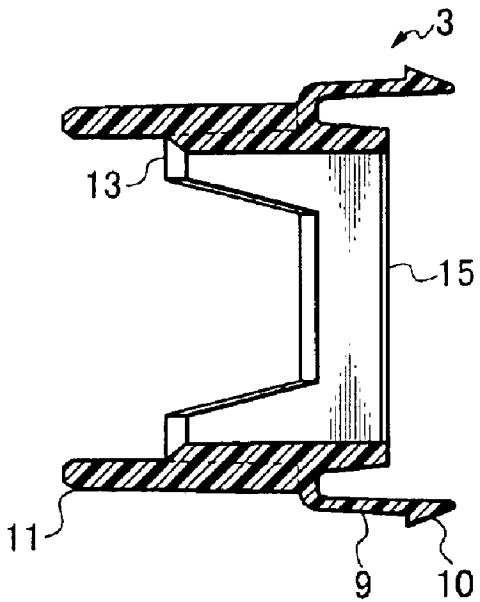
Figure 3A:
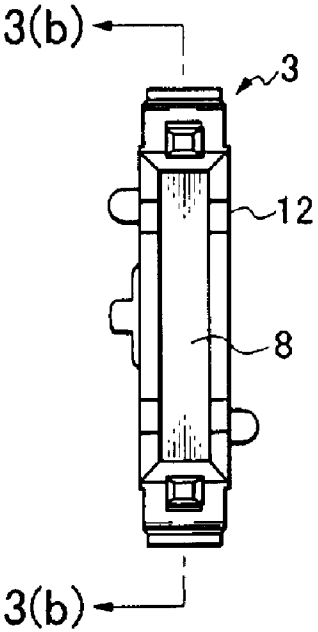

FIGS. 3(*a*)–3(*c*) show the socket 3 to be fixed to the lower printed circuit board 2. The socket 3 comprise a rectangular hollow frame 12 having upper and lower posts 11 and 19 extending upward and downward, and two legs 9 extending downward from the opposite sides of the rectangular hollow frame 12. The rectangular hollow frame 12 has a bottom 15 and an abutment surface 13 formed on its top. Each leg 9 has a nail 10 formed on its free end.

As seen from FIG. 1(*d*), the lower printed circuit board 2 has two square holes 14 and two round holes 20 made therein. The legs 9 of the socket 3 are inserted in the square holes 14 to allow their nails 10 to be caught by the edges of the holes, and the lower posts 19 of the socket 3 are inserted in the round holes 20 of the lower printed circuit board 2. Thus, the socket 3 is firmly fixed to the lower printed circuit board 2.

Referring to FIG. 1(*a*), the lower connector 4 is fixed to the lower printed circuit board 2, and the socket 3 is fixed to the lower printed circuit board 2 with the lower connector 4 press-fitted in the space 8 of the rectangular frame 12 of the socket 3. The exposed conductors of a short length of flexible flat cable 5 are inserted in the insertion holes 7 of the lower connector 4 (see FIG. 2(*a*)). Also, the upper connector 4 is fixed to the upper printed circuit board 1 by inserting and soldering its terminal pins 6 to the terminal holes of the upper printed circuit board 1. FIG. 1(*a*) shows the position prior to establishment of electrical connection of the connector 4 of the upper printed circuit board 1 to the connector 4 of the lower printed circuit board 2 via the intervening flexible flat cable 5.

As shown, the upper posts 11 of the socket 3 are inserted into the holes 16 of the upper printed circuit board 1 whereas the lower posts 19 of the socket 3 are inserted into the holes 20 of the lower printed circuit board 2. Thus, the upper and lower printed circuit boards 1 and 2 are aligned with each other via the intervening socket 3.

FIG. 1(*b*) shows the position prior to abutment of the connector 4 of the upper printed circuit board 1 against the flexible flat cable 5, and FIG. 1(*c*) shows both connectors 4 combined together. The exposed conductors of the flexible flat cable 5 are inserted into the insertion holes 7 of the connector 4 of the lower printed circuit board 2, so that the flexible flat cable 5 stands upright on the connector 4 of the lower printed circuit board 2. The connector 4 of the upper printed circuit board 1 is press-fitted in the rectangular hollow space 8 of the rectangular frame 12 of the socket 3. Thus, both sockets 4 are enclosed in the socket 3.

Figure 4A:
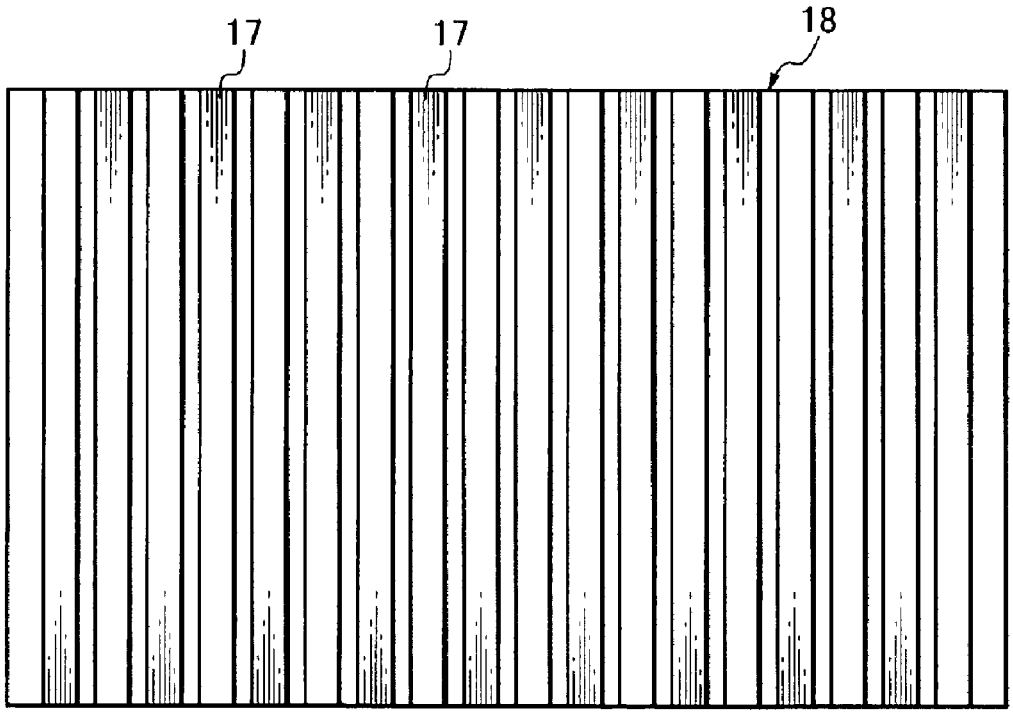
FIGS. 4(*a*) and (*b*) illustrate a length of flat flexible cable lined with a reinforcement piece as viewed from the top and end of the cable.
Figure 4B:
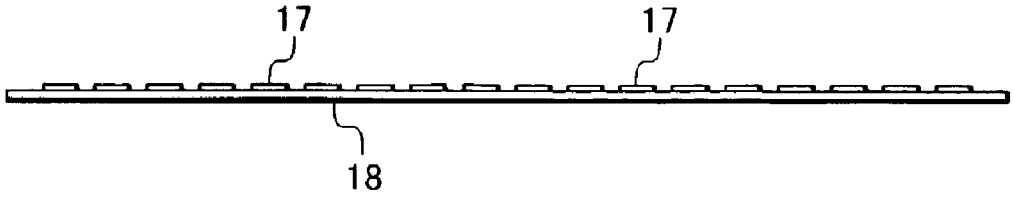
Figure 5:
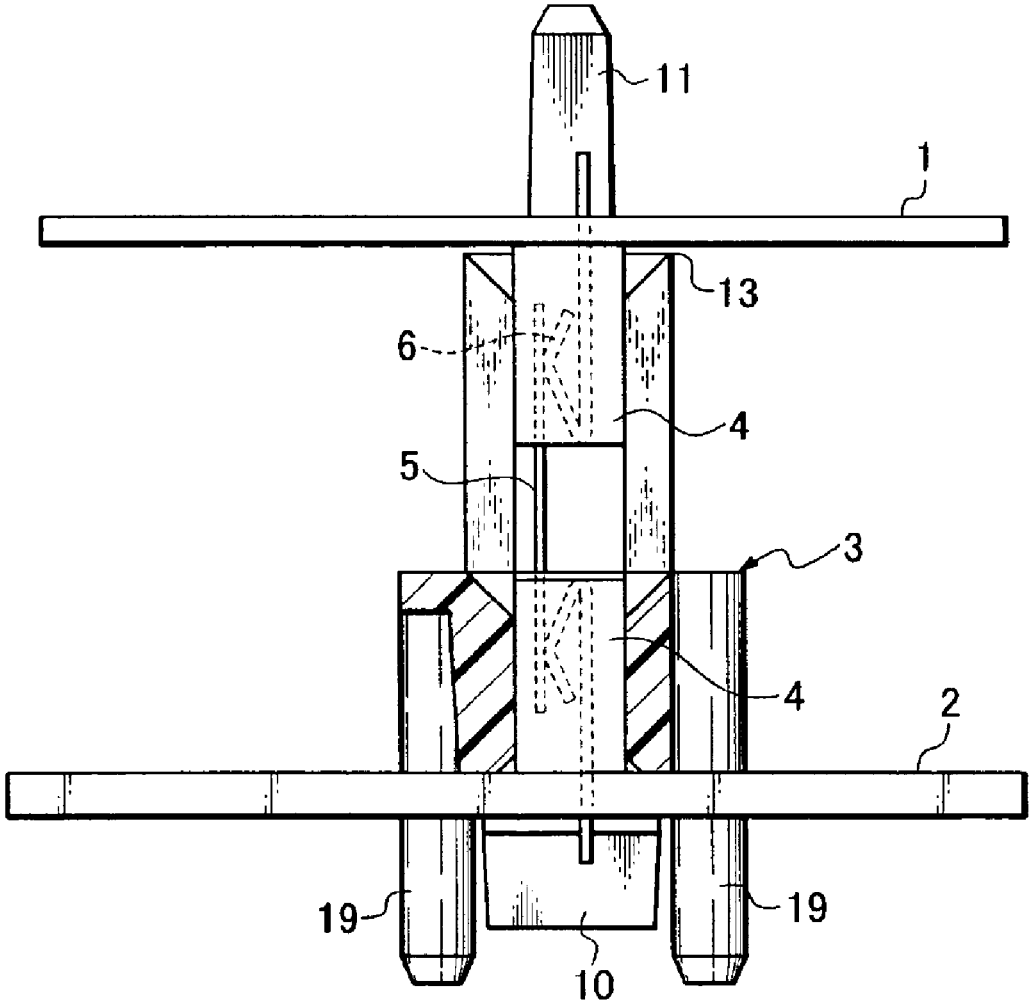
FIG. 5 shows, in section, how two printed circuit boards are joined and electrically connected by the printed circuit board-interconnecting structure.

FIGS. 4(*a*) and 4(*b*) show a short length of flexible flat cable 5. It has a plurality of flat, soft copper strips 17 arranged in parallel at short intervals, and lined with a reinforcement piece 18 of a resin material. The flexible flat cable has an increased resistance to bending force, strong enough not to yieldingly bend when its exposed conductors are inserted into the insertion holes 7 of the connector 4.

Figure 6A:
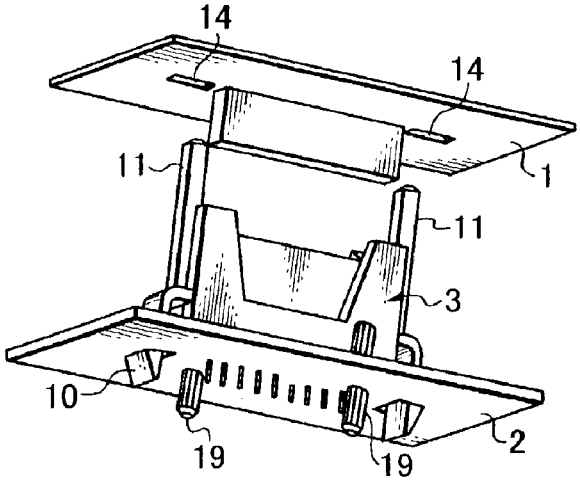
FIGS. 6(*a*), (*b*) and (*c*) illustrate the printed circuit board-interconnecting structure at sequential steps in joining and electrically connecting the upper and lower printed circuit boards.
Figure 6B:
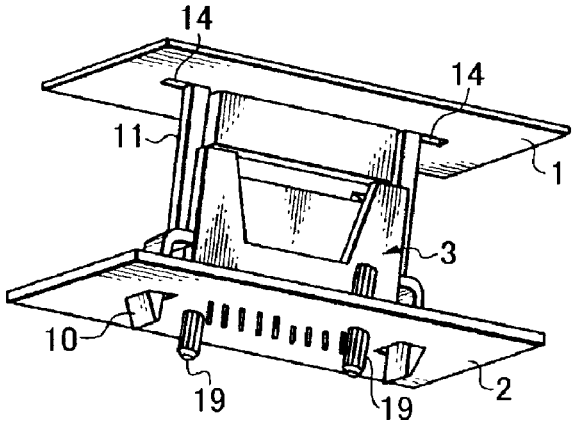
Figure 6C:
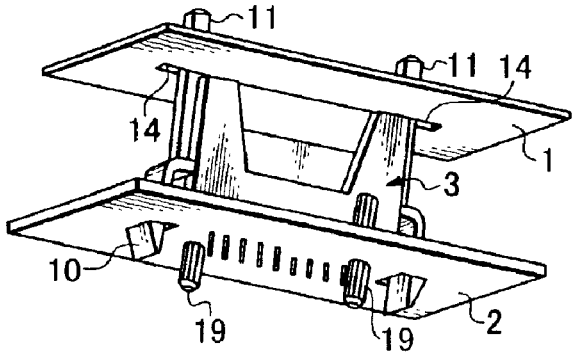
Figure 7A:
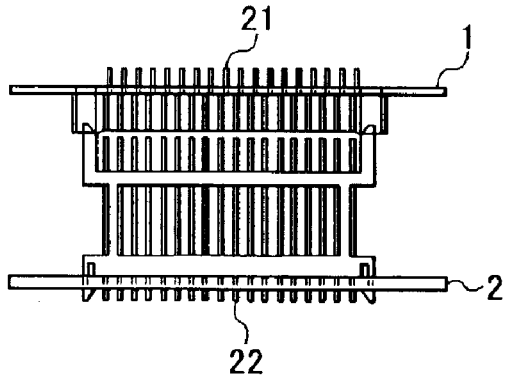
Fig. 7(a) PRIOR ART
FIGS. 7(*a*), (*b*) and (*c*) illustrate the structure of a conventional printed circuit board-interconnecting structure at subsequent steps in coupling the first and second printed circuit boards together.
Figure 7B:
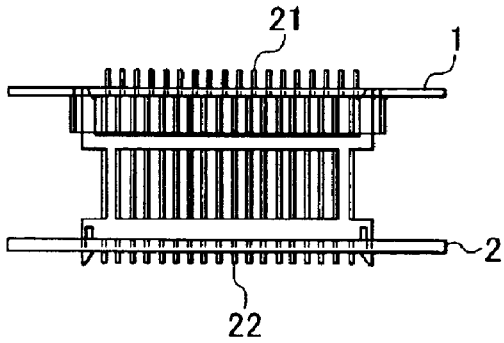
Fig. 7(b) PRIOR ART
Figure 7C:
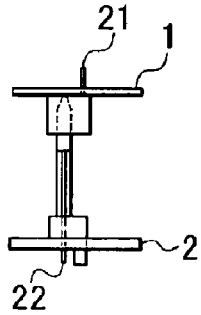
Fig. 7(c) PRIOR ART

FIGS. 6(*a*), (*b*) and (*c*) are perspective views corresponding to FIGS. 1(*a*), (*b*) and (*c*), showing, in succession, fixing one connector 4 and the socket 3 to the lower printed circuit board 2, press-fitting the exposed conductors of the flexible flat cable 5 in the insertion holes 7 of the lower connector 4, and laying the upper printed circuit board-and-connector assembly on the underlying lower printed circuit board-and-connector assembly, thereby combining the upper and lower printed circuit boards 1 and 2 via the flexible flat cable 5.

The printed circuit board interconnecting structure provides the following advantages:

- use of ordinary connectors and short lengths of flexible flat cables both mass-produced and commercially available in the market contributes to significant reduction of the manufacturing cost of printed circuit board interconnecting structures;
- assembling work can be fully automated;
- short flexible flat cables lined with reinforcement pieces effectively prevent the cables from yieldingly bending when being inserted in the connector, thus facilitating the assembling work;
- the confronting connectors and the flexible flat cable are contained in the socket, and the socket can be put in correct position relative to the confronting printed circuit boards by inserting its poles and legs into selected holes made in the printed circuit boards, so that correct alignment of all parts may be assured;
- the inter distance between the confronting printed circuit boards can be adjusted to meet occasional demands simply in respect of the adjustable length of flexible flat cable, permitting use of same connectors and sockets; and
- printed circuit board-interconnecting structures are convenient for transportation because of their low profile, compared with the conventional ones, which must be put in boxes with their printed circuit boards separated a relatively long distance apart because otherwise, the packaged articles would be damaged in transportation.

What is claimed is:

1. Interconnecting structure for electrically connecting two printed circuit boards, leaving a predetermined space therebetween, said structure comprising: two connectors each having terminal pins and being attached to one of the printed circuit boards by inserting the terminal pins into holes of the one of the printed circuit boards; a socket to be fixed to the printed circuit boards, the connectors being adapted to be press-fitted in a hollow space of the socket; and a length of cable, having conductors put in contact with the terminal pins of the connectors, the cable being lined with a reinforcement piece; wherein the socket comprises a rectangular hollow frame having posts extending in opposite directions, and two legs extending from opposite sides of the rectangular hollow frame in one direction, each leg having a nail formed on a free end thereof to be caught by an associated hole formed in one of the printed circuit boards.

2. Interconnecting structure according to claim 1, wherein said length of cable comprises a length of flat flexible cable.

3. Interconnecting structure for electrically connecting two printed circuit boards, leaving a predetermined space therebetween, said structure comprising: two connectors each having terminal pins and being attached to one of the printed circuit boards by inserting the terminal pins into holes of the one of the printed circuit boards; a socket to be fixed to the printed circuit boards, the connectors being adapted to be press-fitted in a hollow space of the socket; and a glass-epoxy printed board having conductors put in contact with the terminal pins of the connectors; wherein the socket comprises a rectangular hollow frame having posts extending in opposite directions, and two legs extending from opposite sides of the rectangular hollow frame in one direction, each leg having a nail formed on a free end thereof to be caught by an associated hole formed in one of the printed circuit boards.

* * * * *